US006575848B2

(12) United States Patent
Bissonnette et al.

(10) Patent No.: US 6,575,848 B2
(45) Date of Patent: Jun. 10, 2003

(54) LOW MODULUS GOLF BALL COMPOSITIONS AND METHODS FOR MAKING SAME

(75) Inventors: Laurent Bissonnette, Portsmouth, RI (US); David A. Bulpett, Boston, MA (US); Derek A. Ladd, Vista, CA (US)

(73) Assignee: Acushnet Company, Fairhaven, MA (US)

( * ) Notice: Subject to any disclaimer, the term of this patent is extended or adjusted under 35 U.S.C. 154(b) by 172 days.

(21) Appl. No.: 09/741,052

(22) Filed: Dec. 21, 2000

(65) Prior Publication Data

US 2002/0119834 A1 Aug. 29, 2002

(51) Int. Cl.[7] ..... A63B 37/06
(52) U.S. Cl. ..... 473/377; 473/351
(58) Field of Search ..... 473/356, 357, 473/362, 363, 354, 377, 351

(56) References Cited

U.S. PATENT DOCUMENTS

| | | | | |
|---|---|---|---|---|
| 3,223,694 A | * | 12/1965 | Farrar | 502/340 |
| 3,239,228 A | * | 3/1966 | Crompton | 473/373 |
| 3,572,721 A | | 3/1971 | Harrison et al. | 372/218 |
| 3,572,722 A | | 3/1971 | Harrison et al. | 273/218 |
| 3,666,272 A | | 5/1972 | Walker et al. | 273/218 |
| 3,846,385 A | * | 11/1974 | Hargis et al. | 502/154 |
| 3,896,102 A | | 7/1975 | Naylor | 260/94.3 |
| 3,926,933 A | | 12/1975 | Naylor | 260/94.3 |
| 3,992,014 A | | 11/1976 | Retford | 273/218 |
| 3,992,561 A | * | 11/1976 | Hargis et al. | 502/340 |
| 4,020,007 A | | 4/1977 | Naylor | 252/429 B |
| 4,020,008 A | | 4/1977 | Naylor | 252/429 B |
| 4,020,115 A | | 4/1977 | Hargis et al. | 260/632 |
| 4,033,900 A | * | 7/1977 | Hargis et al. | 502/154 |
| 4,048,427 A | * | 9/1977 | Hargis et al. | 502/150 |
| 4,683,257 A | | 7/1987 | Kakiuchi et al. | 524/432 |
| 4,919,434 A | | 4/1990 | Saito | 273/235 R |
| 4,929,678 A | | 5/1990 | Hamada et al. | 525/193 |
| 4,931,376 A | * | 6/1990 | Ikematsu et al. | 430/164 |
| 4,955,613 A | | 9/1990 | Gendreau et al. | 273/218 |
| 4,971,329 A | | 11/1990 | Llort et al. | 273/218 |
| 5,141,233 A | | 8/1992 | Yuki et al. | 273/218 |
| 5,252,652 A | | 10/1993 | Egashira et al. | 524/392 |
| 5,508,350 A | * | 4/1996 | Cadorniga et al. | 473/372 |
| 5,553,852 A | | 9/1996 | Higuchi et al. | 473/373 |
| 5,697,856 A | | 12/1997 | Moriyama et al. | 473/374 |
| 5,792,008 A | * | 8/1998 | Kakiuchi et al. | 473/354 |
| 5,827,167 A | * | 10/1998 | Dougan et al. | 273/DIG. 10 |
| 5,833,553 A | | 11/1998 | Sullivan et al. | 473/374 |
| 5,861,465 A | | 1/1999 | Hamada et al. | 525/332.6 |
| 5,981,667 A | * | 11/1999 | Asakura et al. | 525/243 |
| 6,018,007 A | | 1/2000 | Lynch | 526/164 |
| 6,056,842 A | | 5/2000 | Dalton et al. | 156/243 |
| 6,130,295 A | | 10/2000 | Yokota | 525/221 |
| 6,162,135 A | | 12/2000 | Bulpett et al. | 473/373 |
| 6,184,168 B1 | * | 2/2001 | Lynch | 502/102 |
| 6,417,278 B1 | * | 7/2002 | Ladd et al. | 473/373 |

FOREIGN PATENT DOCUMENTS

| | | |
|---|---|---|
| EP | 0 577 058 A1 | 1/1994 |
| GB | 1 168 609 | 10/1969 |
| GB | 1 209 032 | 10/1970 |
| GB | 2 321 021 A | 7/1998 |

* cited by examiner

*Primary Examiner*—Steven Wong
*Assistant Examiner*—Raeann Gorden
(74) *Attorney, Agent, or Firm*—Swidler Berlin Shereff Friedman, LLP

(57) ABSTRACT

Golf balls having a core including a material formed from a controlled-isomer polybutadiene, a crosslinking agent, and a free-radical initiator, or a reaction product thereof, and a cover having a plurality of dimples disposed about the core, wherein the controlled-isomer polybutadiene includes at least about 10 percent to 80 percent trans-isomer and no more than about 5 percent vinyl-configuration polybutadiene and wherein the controlled-isomer polybutadiene has both an absolute molecular weight of at least about 250,000 and a polydispersity of no more than about 3 prior to crosslinking. In particular, golf balls having a compression below about 80 without significant loss of resilience can be advantageously prepared with such materials. Methods of preparing such golf balls are also recited.

30 Claims, 1 Drawing Sheet

LOW MODULUS GOLF BALL COMPOSITIONS AND METHODS FOR MAKING SAME

FIELD OF THE INVENTION

The present invention relates to golf balls including a controlled-isomer polybutadiene in the core, as well as methods for forming the same. In particular, the controlled-isomer polybutadiene is a low modulus composition.

BACKGROUND OF THE INVENTION

Multi-layer golf balls contain a core, which may include one or more layers of solid material or one or more layers of solid material encompassing a fluid therein, and a cover. Optionally, an elastic winding may also be used to form a layer surrounding the center to provide certain playing characteristics. Such balls are known as "wound" balls. The multi-layer golf balls discussed herein include a core and a cover. The terms "core" or "ball core," as used herein, include a center having one or more layers and a mantle formed of one or more layers. The terms "center" or "ball center," as used herein, include a solid and/or fluid mass around which a mantle and a cover are disposed. The mantle is disposed between the center and the cover, typically in concentric fashion, with the cover being the outermost portion of the ball.

A variety of golf ball compositions are known and used in various methods of manufacture. Compositions typically including greater than 35 percent cis-1,4-polybutadiene isomer and preferably greater than 90 percent cis-polybutadiene isomer are often used in forming golf ball cores, or a portion thereof. A number of references disclosing various cis-polybutadiene materials are discussed below.

U.S. Pat. No. 3,239,228 discloses a solid golf ball having a core molded of polybutadiene rubber with a high sulfur content, and a cover. The polybutadiene content of the core is stereo-controlled to the configuration 25–100 percent cis- and 0–65 percent trans-1,4-polybutadiene, with any remainder having a vinyl configuration of polybutadiene. A preferred embodiment of the polybutadiene golf ball core contains 35 percent cis-, 52 percent trans-, and 13 percent vinyl-polybutadiene. The level of trans- and vinyl-content are disclosed to be unimportant to the overall playing characteristics of the polymer blend.

U.S. Pat. No. 3,666,272 discloses solid golf balls and compositions used therein including polybutadiene elastomer having at least 35 percent cis-content, gum plastic, inert inorganic filler, polyfunctional co-curing monomer ester, and a free-radical initiator.

British Patent No. 1,168,609 discloses a molding composition from which improved golf ball cores can be molded and which contains cis-polybutadiene as a basic polymer component. The core polymer component typically includes at least 60 percent cis-polybutadiene, with the remainder being either the trans- or vinyl-forms of polybutadiene. In a preferred embodiment, the core polybutadiene component contains 90 percent cis-configuration, with the remaining 10 percent being either the trans- or vinyl-configurations of 1,4-polybutadiene.

British Patent No. 1,209,032 discloses a two- or three-piece golf ball having a core and a cover. The core or cover material can be any material capable of being crosslinked. In particular, the material can be a polymer or a copolymer of butadiene or isoprene. Preferably, the polymer component is polybutadiene having a cis content of greater than 50 percent by weight.

U.S. Pat. Nos. 3,572,721 and 3,572,722 disclose a solid, one- or two-piece golf ball, with the two-piece ball having a core and a cover. The cover material can include any one of a number of materials, or blends thereof, known to those of ordinary skill in the art, including trans-polybutadiene which may be present in an amount from at least 90 percent, with the remainder being the cis- and/or vinyl configuration.

U.S. Pat. Nos. 3,896,102; 3,926,933; 4,020,007; and 4,020,008 disclose a 1,3-butadiene component and a method and catalyst for preparing trans-polybutadiene, and that it is well known that increasing content of trans-polybutadiene is more resinous and produces a more elastic, tough, crystalline, thermoplastic solid. The '933 and '008 patents further disclose that trans-polybutadiene is resistant to attack by ozone and other chemical agents, and is typically used in insulation, battery cases, and golf ball covers.

U.S. Pat. No. 3,992,014 discloses a one-piece, solid golf ball. The golf ball material is typically polybutadiene, with a stereo-configuration selected to be at least 60 percent cis-polybutadiene, with the remaining 40 percent being the trans-polybutadiene and/or 1,2-polybutadiene (vinyl) isomers.

U.S. Pat. No. 4,020,115 discloses the preparation of homopolymers and random copolymers of butadiene with styrene and/or isoprene that include butadiene units having a low vinyl content of not over 12 percent and a trans-polybutadiene structure of from about 70 to 81 percent. These polymers are disclosed to have broad molecular weight distribution, as well as tack and green-strength desired for manufacturing tires. A variety of trans-polybutadiene and vinyl-polybutadiene materials are also disclosed with the catalysts used for the preparation thereof.

U.S. Pat. No. 4,683,257 discloses solid golf balls formed from a blend of polybutadienes prepared with nickel and/or cobalt base catalysts and a lanthanide rare earth element base catalyst, each containing at least 40 percent cis-polybutadiene isomer.

U.S. Pat. No. 4,919,434 discloses a two-piece golf ball having a solid core of more than 40% cis-1,4-polybutadiene isomer and a cover having an inner layer of 0.1 to 2 mm thickness and an outer layer of 0.1 to 1.5 mm thickness. The inner layer is a thermoplastic resin, such as an ionomer, polyester elastomer, polyamide elastomer, thermoplastic urethane elastomer, propylene-butadiene copolymer, 1,2-polybutadiene, polybutene-1, and styrene-butadiene block copolymer, either individually or in combination.

U.S. Pat. No. 4,929,678 discloses a rubber composition for golf balls including at least 40 percent by weight polybutadiene rubber with a Mooney viscosity of 45 to 90 and a cis-bond content of at least 80 percent, a co-crosslinking agent, and a peroxide. These polymers are disclosed to have a dispersity of between 4.0 to 8.0, which is a ratio of weight average molecular weight to number average molecular weight.

U.S. Pat. No. 4,931,376 discloses butadiene polymers and copolymers with another conjugated diene having at least 80 percent butadiene by weight; 60 to 98 percent trans-polybutadiene linkages; a molecular weight distribution of 1.1 to 4.0; melting temperature of 40° C. to 130° C.; and a content of insolubles in boiling cyclohexane of 1% or less, as well as processes for making the same. Weight average molecular weights of 30,000 to 300,000 and trans-polybutadiene contents greater than about 30 percent are preferred. These materials are disclosed for use in golf ball covers, splint or gyps material, and the like.

U.S. Pat. No. 4,955,613 discloses golf balls made from two polybutadienes, each having a Mooney viscosity below about 50 and a cis-polybutadiene isomer content of greater than about 40 percent, more preferably greater than about 90 percent, and catalysts for preparing the polybutadienes.

U.S. Pat. No. 4,971,329 discloses solid golf balls made from polybutadiene mixtures of about 99.5 to 95 weight percent cis-1,4-polybutadiene and about 0.5 to 5 weight percent vinyl-1,2-polybutadiene. The cis-polybutadiene is made by blending from about 80 percent to 100 percent by weight of cis-polybutadiene with a cis-content of 95 percent and about 0 weight percent to 20 weight percent of cis-polybutadiene with a cis-content of about 98 percent.

U.S. Pat. No. 5,141,233 discloses rubber compositions and golf balls made therewith, where the compositions include at least one natural and/or synthetic rubber component, fine inorganic fibers subjected to surface treatment with an agent and a non-sulfur type vulcanizing agent to provide excellent durability, bounce impact elasticity, and excellent feeling on hitting. The compositions should include at least 30 percent cis-polybutadiene isomer content.

U.S. Pat. No. 5,252,652 discloses a one-piece or multi-layered golf ball core with improved flying performance from a rubber composition comprising a base rubber, preferably 1,4-polybutadiene with a cis-content of at least 40 mole percent, an unsaturated carboxylic acid metal salt, an organic peroxide, and an organic sulfur compound and/or a metal salt thereof. The organic sulfur compound and/or a metal salt is typically present in an amount from about 0.05 to 2 parts per hundred by weight and the organic peroxide is typically present in an amount from about 0.5 to 3 parts per hundred by weight of the total polymer component.

European Patent No. 0 577 058 discloses a golf ball containing a core and a cover that is formed as two separate layers. The inner layer of the cover is molded over the core and is formed from ionomer resin. The outer layer of the cover is molded over the inner layer and is formed from a blend of natural or synthetic balata and a crosslinkable elastomer, such as polybutadiene. In one embodiment of the outer layer of the cover, the elastomer is 1,4-polybutadiene having a cis-structure of at least 40 percent, with the remaining 60 percent being the trans-isomer. A preferred embodiment contains a cis-structure of at least 90 percent and more preferably, a cis-structure of at least 95 percent.

U.S. Pat. No. 5,697,856 discloses a solid golf ball having a core and a cover wherein the core is produced by vulcanizing a base rubber composition containing a butadiene rubber having a cis-polybutadiene structure content of not less than 90 percent before vulcanization. The amount of trans-polybutadiene structure present after vulcanization is 10 to 30 percent, as amounts over 30 percent are alleged to detrimentally result in cores that are too soft with deteriorated resilience performance, and to cause a decrease in golf ball performance. The core includes a vulcanizing agent, a filler, an organic peroxide, and an organosulfur compound.

British Patent No. 2,321,021 discloses a solid golf ball having a core and a cover formed on the core and having a two-layered cover construction having an inner cover layer and an outer cover layer. The outer cover layer is comprised of a rubber composite that contains 0.05 to 5 parts by weight of an organic sulfide compound. The core rubber composition comprises a base rubber, preferably 1,4-polybutadiene having a cis-content of at least 40 percent by weight, a crosslinking agent, a co-crosslinking agent, an organic sulfide, and a filler.

U.S. Pat. No. 5,833,553 discloses core compositions including polybutadiene, natural rubber, metallocene catalyzed polyolefins, polyurethanes, and other thermoplastic or thermoset elastomers, and mixtures thereof having a broad molecular weight range of 50,000 to 500,000, preferably from 100,000 to 500,000. Polybutadiene with a high cis-content is noted as being preferred.

U.S. Pat. No. 5,861,465 discloses thread rubber for wound golf balls having rubber component obtained by vulcanizing rubber composition including rubber selected from natural rubber, synthetic high-cis-polyisoprene rubber, and mixtures with at least one specific diaryl disulfide, a vulcanizing agent, and an antioxidant.

U.S. Pat. No. 6,018,007 discloses the preparation of trans-polybutadiene and other polymers and copolymers having trans configuration in the conjugated diene monomer contributed units with improved catalyst systems. The resulting polymers are rubbery, except those with high trans content, and may be vulcanized by well known methods and incorporated in tires, general rubber goods, and plastics materials.

Additionally, conventional polymers that have a high percentage of the trans-polybutadiene conformation, such as DIENE 35NF, which has 40 percent cis-isomer and 50 percent trans-polybutadiene isomer and which is available commercially from Firestone Corp. DIENE 35NF, however, does not by itself provide for the high resilience values and low modulus desired in golf balls and therefore is not believed to be desirable for such applications.

Polybutadiene polymers used in the prior art tend to exhibit low resilience at low crosslink density. Golf ball manufacturers generally increase the golf ball resilience by increasing the concentration of crosslinking agents. Unfortunately, although increased crosslinks leads to a high coefficient of restitution, they also result in undesirably high modulus materials. High modulus materials provide high compression balls with undesirable feel when struck with a golf club.

It is thus desired to prepare single- and multi-layer golf balls containing low modulus compositions. It is alternatively desired to obtain the same or lower modulus while achieving greater resilience.

SUMMARY OF THE INVENTION

The invention relates to two-piece golf balls having a core and a cover disposed over the core, as well as other multi-layered golf balls having a core including a center and at least one intermediate layer disposed over the center, and at least one cover layer disposed over the core. The controlled-isomer polybutadiene of the present invention may be used in any portion of the golf ball core, although in one preferred embodiment it is included in the center. It should also be understood that the golf ball may include one or more wound layers in the core, each such layer having at least one tensioned elastomeric thread wound about the center or another intermediate layer. The controlled-isomer polybutadiene of the invention may also be used to form the one or more threads for such a wound layer, either alone or in combination with controlled-isomer polybutadiene being used in other portions of the core. The invention also relates to a multi-layer ball having a fluid center surrounded by a shell to contain the fluid, wherein at least one intermediate layer about such a fluid-filled center includes the controlled-isomer polybutadiene.

The invention relates to a golf ball having a core including a material formed from a controlled-isomer polybutadiene polymer, a crosslinking agent, and a free-radical initiator, or a reaction product thereof; and a cover having a plurality of dimples disposed about the core, wherein the controlled-isomer polybutadiene includes at least about 10 percent to 80 percent trans-isomer and no more than about 9 percent vinyl-isomer. In one embodiment, the controlled-isomer polybutadiene has both an absolute molecular weight of at least about 210,000 and a polydispersity of no more than about 3 prior to crosslinking. In one embodiment, the controlled isomer polybutadiene includes from about 20 percent to 60 percent trans-isomer. In a preferred embodiment, the controlled isomer polybutadiene includes from about 15 percent to 80 percent trans-isomer.

In various embodiments, the isomers may be randomly, pseudo-randomly, or block distributed, although the random or pseudo-random distributions are preferred. In one embodiment, the cover has at least one of a dimple coverage of greater than about 60 percent, a hardness from about 35 to 80 Shore D, or a flexural modulus of greater than about 500 psi, and wherein the golf ball has at least one of a compression from about 50 to 120 or a coefficient of restitution of greater than about 0.7.

In a preferred embodiment, the core has an effective modulus of no greater than about 10,000 psi. In a more preferred embodiment, the core has an effective modulus of no greater than about 8,000 psi. In one embodiment, the controlled-isomer polybutadiene has less than about 5 percent vinyl-polybutadiene, while in another embodiment the amount is less than about 3 percent vinyl-polybutadiene. In another embodiment, the controlled-isomer polybutadiene has an absolute molecular weight average of at least about 210,000, while in another embodiment the controlled-isomer polybutadiene has both an absolute molecular weight of at least about 300,000. In a preferred embodiment, the controlled-isomer polybutadiene has an absolute molecular weight average of at least about 350,000. In another embodiment, the controlled-isomer polybutadiene has a polydispersity of no greater than about 2.5. In a preferred embodiment, the controlled-isomer polybutadiene has a polydispersity of no greater than about 2. In one embodiment, the controlled-isomer polybutadiene is provided in the form of regrind having a particle size of about 0.1 micrometers to 1000 micrometers. In one embodiment, the controlled-isomer polybutadiene has a substantially uniform amount of trans-isomer after polymerization.

In one embodiment, the core includes a center and at least one intermediate layer. In one embodiment, the controlled-isomer polybutadiene material is disposed in the center. In another embodiment, either alternatively or in addition to the above embodiment, at least one of the intermediate layers includes the controlled-isomer polybutadiene. In another embodiment, the center includes a fluid. In yet another embodiment, at least one of the intermediate layers includes a tensioned elastomeric thread wound about the center. In this situation, the tensioned elastomeric thread includes the controlled-isomer polybutadiene in one embodiment.

The invention also relates to a method of preparing a golf ball, which includes combining a crosslinking agent, a free-radical initiator, and an uncrosslinked controlled-isomer polybutadiene having an absolute molecular weight of at least about 210,000 and a polydispersity of no more than about 3 to form a core mixture; forming a golf ball core having a material comprising the core mixture, or a product thereof; and providing a cover having a plurality of dimples about the core, wherein the controlled-isomer polybutadiene includes at least about 10 percent to 80 percent trans-isomer and no more than about 9 percent vinyl-isomer.

The core forming step can include the steps of forming a center and providing at least one intermediate layer about the center. In one embodiment, the center includes the controlled-isomer polybutadiene. In another embodiment, the at least one intermediate layer comprises the controlled-isomer polybutadiene and the center comprises a fluid.

BRIEF DESCRIPTION OF THE DRAWINGS

Further features and advantages of the invention can be ascertained from the following detailed description which is provided in connection with the attached drawings, wherein.

DEFINITIONS

Figure 1:
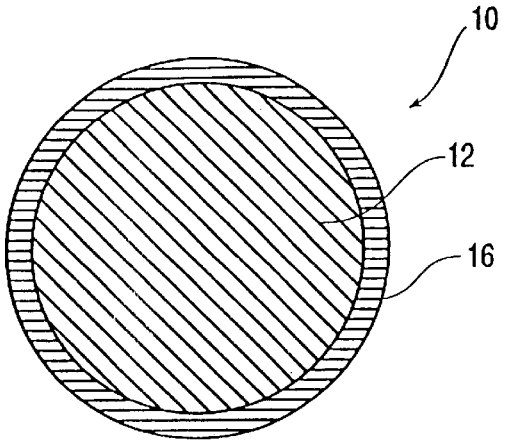
FIG. 1 is a cross-sectional view of a two-piece golf ball having a cover and a core according to the invention.

The term "about," as used herein in connection with one or more numbers or numerical ranges, should be understood to refer to all such numbers, including all numbers in a range.

As used herein, the terms "Atti compression" and "compression" are defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. Compression values are dependent on the diameter of the article being measured. When the Atti Gauge is used to measure cores having a diameter of less than 1.680 inches, it should be understood that a metallic or other suitable shim is used to make the measured object 1.680 inches in diameter.

As used herein, the term "coefficient of restitution" for golf balls is defined as the ratio of the rebound velocity to the inbound velocity when balls are fired into a rigid plate. The inbound velocity is understood to be 125 ft/s.

As used herein, the term "fluid" includes a liquid, a paste, a gel, a gas (such as air), or any combination thereof.

As used herein, the terms "intermediate layer" and "mantle" are interchangeable and refer to an optional part of a golf ball core that, when present, are disposed about the center and in turn have a cover disposed about the mantle. The mantle or intermediate layer portion of the ball may include one or more layers, each of which may be formed by assembling two "half-shells," "preps," "preforms" or the like about the center.

As used herein, the term "molecular weight" ($M_w$) is defined as the absolute weight average molecular weight unless otherwise specified.

As used herein, the term "parts per hundred", also known as "phr", is defined as the number of parts by weight of a particular component present in a mixture, relative to 100 parts by weight of the total polymer, such as polybutadiene. Mathematically, this can be expressed as the weight of an ingredient divided by the total weight of the polymer, e.g., polybutadiene, multiplied by a factor of 100.

As used herein, the term "polydispersity" means $M_w/M_n$, where $M_n$ (the number average molecular weight)=Total Weight(Daltons)/Number of Molecules.

As used herein, "Shore D hardness" is determined according to ASTM D-2240, as modified by making all measurements on a sphere, such as on the spherical body of a golf ball core or ball, unless stated otherwise.

DETAILED DESCRIPTION OF THE INVENTION

A new composition including controlled-isomer polybutadiene for inclusion in one or more layers of a golf ball core, preferably for inclusion in the center, and a method for manufacturing such golf ball cores has now been discovered. The invention advantageously provides a reduced modulus golf ball core without a significant reduction in resilience, which results in a golf ball having improved playing characteristics. Furthermore, such high resilience, low modulus materials prepared according to the invention may be used by golf ball manufacturers to develop resilient golf balls with specifically tailored spin characteristics.

Although the core may be only one layer, it is preferred that the core including the controlled-isomer polybutadiene component include a center and at least one intermediate layer disposed thereabout. The center may be solid or fluid-filled. The center is generally spherical and when the core has multiple layers the center is generally about 0.5 inches to 1.5 inches, preferably about 0.8 inches to 1.3 inches, and more preferably about 1 to 1.2 inches in diameter. It is envisioned that a tensioned elastomeric thread or strip may be wound around the center, either before or after additional intermediate layers are be added to form a wound layer.

The controlled-isomer polybutadiene of the invention may be used to form the center or one or more of the intermediate layers of the core, or any combination thereof. In one embodiment, the golf ball can be formed with a core including the controlled-isomer polybutadiene, with one or more cover layers being disposed about the core. In another embodiment, the golf ball can be formed with a core having a center and at least one intermediate layer, and at least one cover layer disposed about the core. In this embodiment, it is preferred that controlled-isomer polybutadiene be included in the softer layer (i.e., has a lower Shore hardness), which is typically the center. Thus, if an intermediate layer disposed about the center is softer than the center, it is preferred that the controlled-isomer polybutadiene be included in such intermediate layer. It should be understood, of course, that the invention also encompasses alternatively including the controlled-isomer polybutadiene in the harder center, or in both the center and the intermediate layer.

The total thickness of the intermediate layer(s), when included, should typically be about 0.1 to 0.6 inches, preferably about 0.15 to 0.35 inches, more preferably about 0.2 to 0.3 inches. The entire core, including the center and optional intermediate layer(s), should have a diameter of about 1.25 to 1.65 inches, preferably 1.38 to 1.6 inches, where twice the thickness of the intermediate layer(s) is included in the core diameter since they enclose the center. The diameter of the mantle corresponding to a particular center, and of the cover formed around the mantle and center, may be adjusted according to the diameter of the center to provide a golf ball formed according to the invention with the overall minimum diameter required by the USGA once the cover is applied. The mantle, when included, should be thick enough to form the core when molded over the center. The minimum mantle thickness, when intermediate layer(s) are included, is readily determined by one of ordinary skill in the art, and may depend upon the specific materials used to form the mantle as well as the thickness of the center, the cover, and the presence of other mantle layers. One example of a preferred ball center size according to the invention is a center having a diameter of 1.08 inches and a mantle having a thickness of 0.25 inches to provide a core having a 1.58 inch diameter. A cover of 0.05 inches thickness is then applied to provide a golf ball having a diameter of about 1.68 inches. The golf balls including the controlled-isomer polybutadiene typically range in size from about 1.5 to 1.8 inches, preferably about 1.6 to 1.8 inches, and more preferably from about 1.64 to 1.74 inches. Most preferably, the golf ball will comply with the USGA rules of golf.

Although the methods and compositions of the invention are suitable for making other types of game balls, they are best used for golf balls. The controlled-isomer polybutadiene composition of the invention can be used in any portion or layer of a golf ball, such as the center, an intermediate layer, or a cover. Preferably, the compositions are in the core. The compositions can be advantageously used in forming a center where a plurality of shells are assembled about the center to form at least one intermediate layer. The shells and resultant mantle may alternatively or additionally include the controlled-isomer polybutadiene material formed from the combination of controlled-isomer polybutadiene discussed herein, a free-radical initiator, and optionally but preferably one or more crosslinking agents and/or fillers, or a reaction product thereof. Typically the fillers are inert and will not react with the other ingredients present.

The controlled-isomer polybutadiene polymer typically includes at least about 10 percent up to 80 percent trans-isomer content with the rest being cis-isomer and vinyl-isomer distributed randomly, pseudo-randomly, or block along the same polybutadiene backbone. Thus, the controlled-isomer polybutadiene polymer of the invention is to be distinguished from the conventional cis-polybutadienes most often used in forming golf ball cores. In various embodiments, the trans-isomer content of the controlled-isomer polybutadiene may be from about 10 percent to 20 percent, about 20 percent to 30 percent, about 30 percent to 40 percent, about 40 percent to 50 percent, about 50 percent to 60 percent, about 60 percent to 70 percent, and about 70 percent to 80 percent, as well as any of the lower end of any of these ranges matched with any of the upper end of these ranges, e.g., from about 30 percent to 70 percent. In one preferred embodiment, the trans-isomer content is present in about 15 percent to 80 percent of the polybutadiene.

In one preferred embodiment, the portion of the golf ball including the controlled-isomer polybutadiene, e.g., the center, at least one intermediate layer, tensioned material for a winding, and the like, has a substantially uniform amount of trans-isomer after polymerization. For example, the controlled-isomer polybutadiene may be polymerized having substantially 50 percent trans-isomer at every given point throughout the polymer before or after the material is cured, or before and after the cure. "Substantially uniform" refers to a material having less than a 10 percent deviation, preferably less than a 5 percent deviation, more preferably less than a 1 percent deviation, in the amount of trans-isomer from the average amount of trans-isomer in the controlled-isomer polybutadiene.

Without being bound by theory, it is now believed that vinyl-isomer (1,2-polybutadiene) is undesirable since vinyl-isomer is detrimental to resilience of the polybutadiene component of the invention. Thus, the vinyl-content of the present invention is typically present in no more than about 9 percent, preferably less than about 5 percent, and more preferably less than about 3 percent, of the isomer content in the controlled-isomer polybutadiene. The presence of vinyl-isomer is now believed to be an undesirable result of the polybutadiene polymerization process, and proper selection of polymerization catalyst and process conditions may be readily selected by one of ordinary skill in the art to minimize vinyl formation.

Similarly, it is now believed that minimizing the gross number of chain ends in the controlled-isomer polybutadiene polymer of the invention tends to increase resilience. As molecular weight increases, however, mixing characteristics are adversely affected due to the high polymer viscosity. One way to reduce chain ends is by increasing the molecular weight average and providing a low polydispersity. Thus, prior to crosslinking, the controlled-isomer polybutadiene component also typically has a polydispersity of no greater than about 3, and preferably no greater than about 2.5, and more preferably no greater than about 2. In one preferred embodiment, the polydispersity is no greater than about 1.5.

The controlled-isomer polybutadiene component of the invention typically has a high absolute molecular weight average prior to crosslinking, defined as being at least about 250,000, preferably from about 250,000 to 1,000,000. In one embodiment, the absolute molecular weight average is from about 300,000 to 750,000 and in another embodiment it is from about 350,000 to 700,000.

The molecular weight is measured as follows. Approximately 20 mg of polymer is dissolved in 10 mL of THF, which may take a few days at room temperature depending on the polymer's molecular weight and distribution. One liter of THF is filtered and degassed before being placed in an HPLC reservoir. The flow rate of the HPLC is set to 1 mL/min. through a Viscogel column. This non-shedding, mixed bed, column model $GMH_{HR}$-H, which has an ID of 7.8 mm and 300 mm long is available from Viscotek Corp. of Houston, Tex. The THF flow rate is set to 1 mL/min. for at least one hour before sample analysis is begun or until stable detector baselines are achieved. During this purging of the column and detector, the internal temperature of the Viscotek TDA Model 300 triple detector should be set to 40° C. This detector is also available from Viscotek Corp. The three detectors (i.e., Refractive Index, Differential Pressure, and Light Scattering) and the column should be brought to thermal equilibrium, and the detectors should be purged and zeroed, to prepare the system for calibration according to the instructions provided with this equipment.

One hundred microliters of sample solution can then be injected into the equipment and the molecular weight of each sample can be calculated with the Viscotek's triple detector software. When the molecular weight of the polybutadiene material is measured, a dn/dc of 0.130 should always be used. It should be understood that this equipment and these methods provide the molecular weight numbers described and claimed herein, and that other equipment or methods will not necessarily provide equivalent values as used herein.

The controlled-isomer polybutadiene component may be produced by any means available to those of ordinary skill in the art, preferably with a catalyst that results in a polybutadiene having at least 10 percent to 80 percent trans-content and a high absolute molecular weight average, low vinyl content, and low polydispersity, as discussed herein. A variety of literature is available to guide one of ordinary skill in the art in preparing suitable polybutadiene components for use in the invention, including U.S. Pat. Nos. 3,896,102; 3,926,933; 4,020,007; 4,020,008; 4,020,115; 4,931,376; and 6,018,007, each of which is hereby incorporated herein by express reference thereto. One preferred method of providing the controlled-isomer polybutadiene is by using a catalyst including cobalt, barium, nickel, neodymium, lithium, or titanium, or a combination thereof.

Another method for preparing the controlled-isomer polybutadiene of the present invention is by converting a portion of the cis-isomers in a conventional polybutadiene to trans-isomers to form a material from the conversion reaction of an amount of polybutadiene, a free radical source, and a cis-to-trans catalyst including at least one organosulfur component, inorganic sulfide component, an aromatic organometallic compound, a metal-organosulfur compound, elemental sulfur, a polymeric sulfur, or an aromatic organic compound. This conversion reaction is accomplished at a sufficient reaction temperature to form a polybutadiene reaction product that includes an amount of trans-polybutadiene greater than the amount of trans-polybutadiene present before the conversion reaction as disclosed in U.S. Pat. Nos. 6,162,135, 6,465,578, 6,291,592, and 6,458,895. Each of these references is incorporated herein by its entirety by express reference thereto. For example, the definitions of these various cis-to-trans catalyst terms may be found described in one or more of these incorporated documents.

The golf ball may also include conventional polybutadiene having a high cis-content or other resilient polymers. Without being bound by theory, it is now also believed that conventional cis-polybutadienes are susceptible to hysteretic polymer conformation that can reduce polymer resilience and therefore golf ball velocity. It has been discovered that including greater than 10 percent trans-polybutadiene isomer in controlled-isomer polybutadiene according to the invention reduces and may avoid the conformational phenomenon that is believed to reduce resilience in conventional resilient polybutadiene components. Nonetheless, it may be desired to add some amounts of conventional resilient polymer components to the materials of the invention for economic, processing, or other reasons. Preferably, however, it is preferred that the trans-isomer be present in a predominant amount of the controlled-isomer polybutadiene polymer component of the invention.

Suitable additional resilient polymers for use with the controlled-isomer polybutadiene component of the invention when preparing the ball core include conventional cis-polybutadienes that typically contain greater than about 40 percent cis-content, polyisoprene, styrene-butadiene, styrene-propylene-diene rubber, ethylene propylene-diene (EPDM), mixtures thereof, and the like. The additional resilient polymer, when included, can be any suitable resilient polymer but preferably includes polyisoprene or conventional polybutadiene, more preferably includes conventional polybutadiene. One example of a suitable conventional cis-polybutadiene for blending with the controlled-isomer polybutadiene of the invention is CARIFLEX BR 1220, commercially available from H. MUEHLSTEIN & CO., INC. of Norwalk, Conn. The optional resilient polymer component has a high molecular weight average, defined as being at least about 50,000 to 1,000,000, preferably from about 150,000 to 750,000, and more preferably from about 200,000 to 400,000. CARIFLEX BR 1220 is believed to have a molecular weight average of about 372,000.

The polymer portion of the material, which totals "100 phr", preferably includes predominantly the controlled-isomer polybutadiene of the invention, more preferably about 60 to 99 percent, and most preferably from about 70 to 98 percent of the controlled-isomer polybutadiene of the invention. "Predominant" or "predominantly" is used herein to mean greater than about 50 percent. The term "polymer blend" is used herein to mean the blend of the controlled-isomer polybutadiene of the invention and one or more additional resilient polymers readily available to those of one of ordinary skill in the art.

The controlled-isomer polybutadiene of the invention is typically combined with one or more other components to form a material for use in forming a ball core or portion thereof, such as one or more crosslinking agents, free-radical initiators, fillers, and the like. Suitable crosslinking agents for use in the invention include any crosslinking agent available to those of ordinary skill in the art. In particular, exemplary crosslinking agents include one or more metallic salts of unsaturated fatty acids or monocarboxylic acids, such as zinc, calcium, or magnesium acrylate salts, and the like. Preferred acrylates include zinc acrylate, zinc diacrylate, and zinc methacrylate. The crosslinking agent, when included, must be present in an amount sufficient to crosslink the various chains of polybutadiene polymers and any other polymers to themselves and to each other to help properly form the golf ball. The desired elastic modulus for the mantle may be adjusted by varying the amount of crosslinking. This may be achieved, for example, by altering the type and amount of crosslinking agent, which method is well known to those of ordinary skill in the art. The crosslinking agent is thus preferably added in an amount from about 1 to 50 parts per hundred of the polymer, more preferably about 5 to 30 parts per hundred, and most preferably about 10 to 25 parts per hundred, of the "polymer," i.e., the controlled-isomer polybutadiene and any optional resilient polymer components.

Although not required, a free-radical initiator is preferably included in the composition and method. The free-radical initiator may be any compound or combination of compounds present in an amount sufficient to facilitate initiation of a crosslinking reaction between a crosslinking agent and the polybutadiene component and any other polymers present. The free-radical initiator is preferably a peroxide. Suitable free-radical initiators include di(2-t-butyl-peroxyisopropyl)benzene peroxide, 1,1-bis(t-butylperoxy)-3,3,5-trimethylcyclohexane, dicumyl peroxide, di-t-butyl peroxide, 2,5-di-(t-butylperoxy)-2,5-dimethyl hexane, n-butyl-4,4-bis(t-butylperoxy)valerate on calcium silicate, lauroyl peroxide, benzoyl peroxide, t-butyl hydroperoxide, and the like. The free-radical initiator is preferably present in an amount of up to 2 parts per hundred, more preferably about 0.2 to 1 parts per hundred of the polymer.

The components used in forming the golf ball core in accordance with invention may be combined by any type of mixing known to one of ordinary skill in the art. A suitable polymer system, for example, would include 60 weight percent of the controlled-isomer polybutadiene and 40 weight percent of a conventional 95 percent cis-polybutadiene isomer content. For example, a suitable conventional polybutadiene component such as CARIFLEX BR 1220 could be used. This exemplary polymer system would also be combined with a free-radical initiator, such as dicumyl peroxide, which substantially initiates reaction at around 170° C. and a crosslinking agent, such as zinc diacrylate. Suitable types of mixing include single pass and multi-pass mixing, and the like. The crosslinking agent and any other optional additives used to modify the characteristics of the golf ball center, may similarly be combined by any type of mixing. A single-pass mixing process where ingredients are added sequentially is preferred, as this type of mixing tends to increase efficiency and reduce costs for the process. Suitable mixing equipment is well known to those of ordinary skill in the art, and such equipment may include a Banbury mixer or a twin screw extruder. Conventional mixing speeds for combining polymers are typically used, although the speed must be high enough to impart substantially uniform dispersion of the polymer component. On the other hand, the speed should not be too high, as high mixing speeds tend to break down the polymers being mixed and particularly may undesirably decrease the molecular weight of the controlled-isomer polybutadiene or any optional resilient polymer component. The speed should thus be low enough to avoid high shear, which may result in loss of desirably high molecular weight portions of polymer. Also, too high a mixing speed may undesirably result in creation of enough heat to initiate the crosslinking. The maximum suitable mixing temperature depends upon the type and amount of free-radical initiator. For example, when using di(2-t-butyl-peroxyisopropyl)benzene peroxide as the free-radical initiator, a mixing temperature of about 80° C. to 125° C., preferably about 88° C. to 110° C., and more preferably about 90 ° C. to 100° C. is suitable to safely mix the ingredients. The mixing speed and temperature are readily determinable by one of ordinary skill in the art without undue experimentation.

Fillers are typically also added to the composition used in the shells of the mantle, the center, or both ball portions, to adjust the density of the core to conform to uniform golf ball standards. Density-adjusting fillers may also be used to modify the weight of the core for specialty balls used by players, e.g., a lower weight core is preferred for a player having a low swing speed. Fillers typically include processing aids or compounds to affect rheological and mixing properties, the specific gravity, the modulus, the tear strength, reinforcement, and the like. The fillers are generally inorganic, and suitable fillers include numerous metals, metal oxides, and inorganic compounds, such as zinc oxide and tin oxide, and barium sulfate, zinc sulfate, calcium carbonate, barium carbonate, clay, tungsten, tungsten carbide, an array of silicas, cured ground particulate rubber, coloring agents, and the like, and combinations thereof. Another suitable filler is regrind that includes the controlled-isomer polybutadiene of the present invention. In one embodiment, such regrind-based filler is predominantly controlled-isomer polybutadiene. The regrind particles can be from about 0.1 micrometers to 1000 micrometers. The filler(s), when used, may be present in an amount of about 0.5 to 50 weight percent of the polymer composition. In one preferred embodiment, the filler material has a specific gravity of at least about 2.5, preferably at least about 5.

The golf balls of the present invention, or portions thereof, can be prepared as follows. A solid spherical center including the controlled-isomer polybutadiene of the invention, one or more of the other resilient polymer components described herein, or both, is prepared by at least one of conventional compression, injection, or transfer molding techniques. As noted above, the controlled-isomer polybutadiene is preferably included in the center. A fluid-filled center may alternatively be formed instead of a solid center. Any additionally desired center layers may then be added to the center by conventional compression or injection molding techniques, preferably in a concentric fashion to maintain a substantially spherical center.

The mantle preforms may be prepared as ellipsoidal or hemispherical half-shells using conventional compression or injection molding techniques. The preferred method is to prepare two half-shells that fit around the core and merge to form the mantle, or one or more layers thereof. The preforms are preferably prepared by mixing the controlled-isomer polybutadiene component of the invention, any resilient polymer component, or both, with any other desired ingredients together as discussed above. The mixture of polymer components, free-radical initiator, optionally a crosslinking agent, and any fillers may be extruded, calendared, or pelletized for introduction into a molding machine for preparation of the mantle.

The half-shells are preferably injection molded from the mixture based on cost and speed considerations, although compression molding is also suitable. After their formation, the half-shells are assembled about the core. In accordance with the invention, the shells may be produced rapidly with injection molding. The rapid production of shells permits use of automated procedures for assembly about the center. During assembly about the center, when ellipsoidal half-shells are used they tend to self-orient themselves vertically when placed in hemispherical mold cups, which reduces preparation time, cost, and defects. The assembly of the core, i.e., typically two half-shell preforms and a center, may be compression molded. When the mold halves are combined, they form a rigid, spherical cavity. Once the mold is closed, the excess material from the shell crowns is forced out of the mold cavity at the equator where the mold halves combine. The compression molding of the assembled preforms and center tends to take about 5 to 40 minutes, although times may vary depending upon the types and amounts of materials used, as will be readily determined by one of ordinary skill in the art in view of the disclosure herein. For example, a typical compression molding cycle may take 12 minutes at around 174° C. The shells are forced together by the mold and substantially cured during molding. Optionally, if additional mantle layers are desired, e.g., having different characteristics to improve or modify the overall ball qualities, they may be provided over the first mantle layer. Additional mantle layers are preferably added after the previous mantle layer is cured, although they may be added before cure of the previous layer if the pre-cured mantle layer is rigid enough so that substantially no mixing of the layers occurs.

Any conventional material or method may be used in preparing the golf ball cover disposed over the core. For example, as is well known in the art, ionomers, balata, and urethanes are suitable golf ball cover materials. A variety of less conventional materials may also be used for the cover, e.g., thermoplastics such as ethylene- or propylene-based homopolymers and copolymers. These homopolymers and copolymers may also include functional monomers such as acrylic and methacrylic acid, fully or partially neutralized ionomers and their blends, methyl acrylate, methyl methacrylate homopolymers and copolymers, imidized amino group-containing polymers, polycarbonate, reinforced polycarbonate, reinforced polyamides, polyphenylene oxide, high impact polystyrene, polyether ketone, polysulfone, poly(phenylene sulfide), acrylonitrile-butadiene, acrylic-styrene-terephthalate, poly(ethylene terephthalate), poly(butylene terephthalate), poly(ethylene-vinyl alcohol), poly(tetrafluoroethylene), and the like. Any of these polymers or copolymers may be further reinforced by blending with a wide range of fillers, including glass fibers or spheres, or wood pulp. The selection of a suitable cover, and application thereof over the mantle described herein, will be readily determinable by those of ordinary skill in the art when considering the disclosure herein. One preferred cover includes a cast, thermoset polyurethane material. In one embodiment, such a cover preferably includes at least an inner and an outer cover layer, at least one of which includes the cast thermoset polyurethane.

The resulting ball, after a suitable cover is applied by conventional techniques, exhibits improved characteristics such as the low spin and high coefficient of restitution desired by the vast majority of golf players.

When golf balls are prepared according to the invention, they typically will have dimple coverage greater than about 60 percent, preferably greater than about 65 percent, and more preferably greater than about 70 percent. As measured by ASTM method D-6272-98 on materials conditioned for at least two weeks, the flexural modulus of the cover material for use on the golf balls is typically greater than about 500 psi, and is preferably from about 500 psi to 150,000 psi. The hardness of the cover material is typically from about 35 to 80 Shore D, preferably from about 40 to 78 Shore D, and more preferably from about 45 to 75 Shore D. The resultant golf balls typically have a coefficient of restitution of greater than about 0.7, preferably greater than about 0.75, and more preferably greater than about 0.78. The golf balls also typically have a compression of at least about 40, preferably from about 50 to 120, and more preferably from about 60 to 100. The specific gravity is typically from about 0.7 to 2 for the cured polybutadiene material of the invention. In another embodiment, the specific gravity is from about 0.9 to 1.5 for the cured polybutadiene material of the invention.

The controlled-isomer polybutadiene of the present invention typically has an effective modulus of no greater than about 7,500 psi, preferably from about 500 psi to 7,500 psi, more preferably from about 1,000 psi to 5,000 psi. The effective modulus is measured on solid spherical bodies, typically a golf ball, cured golf ball core, or cured golf ball center using a conventional load testing frame such as an Instron 5565 available from Instron Corporation, Canton, Mass. The effective elastic modulus is independent of sphere diameter and inherently includes any material property gradients within the cured sphere. Traditionally, in the golf ball art, compression values are measured with Atti or Riehle gauges or are reported as deflection values at particular loads as well as loads for particular deflection values. These methods are ambiguous since the diameter of the body greatly effects the reported value. Using the effective modulus measurement eliminates ambiguity and quantifies an inherent average material property, elastic modulus. The formula set forth in "Roark's Formula for Stress & Strain," pp. 650 (1989) provides the basis for deriving a relationship between elastic tensile modulus and the load deflection profile of a spherical body. The formula describing the load deflection response for a sphere compressed between two platens in terms of its effective elastic modulus is:

$$Y=2.08*[P^2*C_e^2/D]^{1/3}$$

Where, $C_e=(1-\nu_p^2)/E_p+(1-\nu_s^2)/E_s$

Y is the spheres deflection (inches)

P is the applied load (pounds)

D is the sphere diameter (inches)

$\nu_p$ is Poisson's ratio for the compressing platens (typically 0.3 for steel)

$\nu_s$ is Poisson's ratio for the sphere (typically 0.48 for elastomeric polymers)

$E_p$ is the elastic modulus for the compressing platens (typically $30\times10^6$ psi for steel)

$E_s$ is the effective elastic modulus for the sphere (psi)

The method for obtaining effective elastic modulus includes: (1) Measuring the average diameter of the sphere; (2)

measuring the load deflection profile of the sphere for a deflection of at least 10 percent of the spheres diameter, where the data should contain at least 20 load and deflection data pairs equally spaced for each 0.5 percent deflection and the rate of deflection should be 25 mm per minute; and (3) a least squares numerical algorithm should be used to determine the elastic modulus for the sphere, which ensures that the above disclosed equation for load deflection provides an accurate fit to the measured data. Least squares numerical algorithms for curve fitting are commonly available and may be readily implemented by one of ordinary skill in the art. For example, Microsoft Excel® contains a solver that will readily perform the least squares function.

Additionally, the unvulcanized rubber, such as polybutadiene, in golf balls prepared according to the invention typically has a Mooney viscosity greater than about 20, preferably greater than about 30, and more preferably greater than about 40. Mooney viscosity is typically measured according to ASTM D-1646-99.

Figure 2:
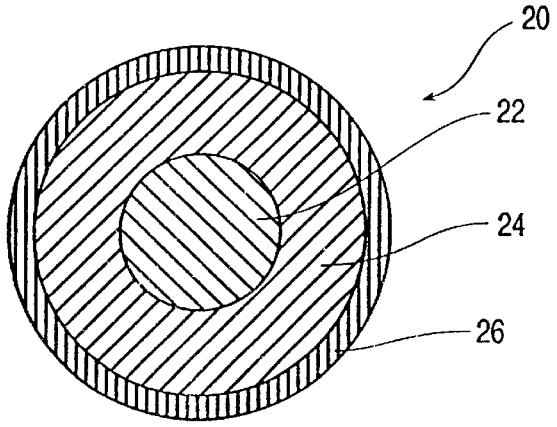
FIG. 2 is a cross-section of a golf ball having an intermediate layer between a cover and a center according to the invention.
Figure 3:
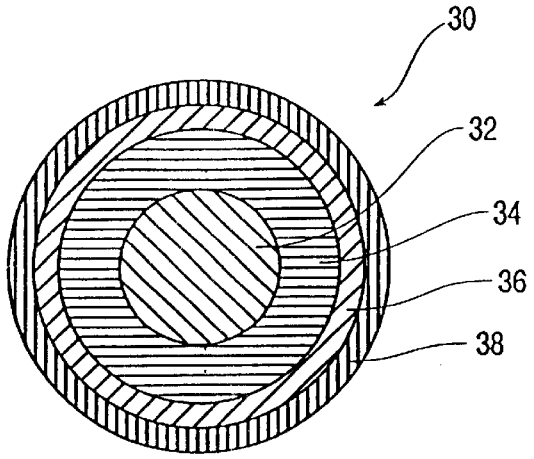
FIG. 3 is a cross-section of a golf ball having more than one intermediate layer between a cover and a center according to the invention.

Referring to FIG. 1, a golf ball 10 of the present invention can include a core 12 and a cover 16 surrounding the core 12. In this embodiment, the core includes the controlled-isomer polybutadiene of the invention. Referring to FIG. 2, a golf ball 20 of the present invention can include a center 22, a cover 26, and at least one intermediate layer 24 (only one such layer is depicted) disposed between the cover and the center. Each of the cover and center may include more than one layer (not shown); i.e., the golf ball can be a conventional three-piece wound ball, a two-piece ball, a ball having a multi-layer core or an intermediate layer or layers, a fluid-filled ball, etc. The controlled-isomer polybutadiene of the invention can be included in the center 22, the one or more intermediate layers 24, or both. Referring to FIG. 3, a golf ball 30 of the present invention can include a center 32, a cover 38, and intermediate layers 34 and 36 disposed between the cover and the center. Although FIG. 3 shows only two intermediate layers, it will be appreciated that any number or type of intermediate layers may be used, as desired. In FIG. 3, the controlled-isomer polybutadiene could be included in the center 32, one or both of the intermediate layers 34, 36, or any combination thereof. It should be understood that the controlled-isomer polybutadiene can be included in any of the layers of these figures, or any combination of such layers.

EXAMPLES

The following examples are provided only for the purpose of illustrating the invention and are not to be construed as limiting the invention in any manner.

Examples 1–24

Trans-Isomer Polybutadienes Prepared According to the Invention

Trans-isomer polybutadiene polymers can be prepared from a butadiene monomer according to the invention using a variety of catalysts. These polymers are made to provide the percentage of isomers desired for particular properties in the final end-product, as well as being prepared so as to have a certain desired weight average molecular weight and/or polydispersity. A variety of suitable trans-isomer polybutadiene polymers can be prepared with the following quantity of isomers therein.

| Example # | Trans-Isomer (%) | Cis-Isomer (%) | Vinyl-Isomer (%) |
|---|---|---|---|
| 1 | 10 | 81 | 9 |
| 2 | 10 | 85 | 5 |
| 3 | 10 | 89.9 | 0.1 |
| 4 | 20 | 71 | 9 |
| 5 | 20 | 75 | 5 |
| 6 | 20 | 79.9 | 0.1 |
| 7 | 30 | 61 | 9 |
| 8 | 30 | 65 | 5 |
| 9 | 30 | 69.9 | 0.1 |
| 10 | 40 | 51 | 9 |
| 11 | 40 | 55 | 5 |
| 12 | 40 | 59.9 | 0.1 |
| 13 | 50 | 41 | 9 |
| 14 | 50 | 45 | 5 |
| 15 | 50 | 49.9 | 0.1 |
| 16 | 60 | 31 | 9 |
| 17 | 60 | 35 | 5 |
| 18 | 60 | 39.9 | 0.1 |
| 19 | 70 | 21 | 9 |
| 20 | 70 | 25 | 5 |
| 21 | 70 | 29.9 | 0.1 |
| 22 | 80 | 11 | 9 |
| 23 | 80 | 15 | 5 |
| 24 | 80 | 19.9 | 0.1 |

The material in any of these examples can be formed into at least a portion of a golf ball, as will be readily apparent to those of ordinary skill in the art. For example, one suitable recipe for forming such a golf ball portion includes 100 parts of the trans-isomer converted polybutadiene, 0.1 to 1 part by weight of a peroxide such as dicumyl peroxide or any other suitable free-radical initiator, 0.1 to 40 parts by weight of zinc diacrylate, or any other suitable metallic salt or combination thereof of an unsaturated fatty acid or monocarboxylic acid, and 10 parts by weight of powdered tungsten filler. The resultant material can be used to form one or more layers of a golf ball, such as the center, or an intermediate layer or cover layer.

It is to be recognized and understood that the invention is not to be limited to the exact configuration as illustrated and described herein. For example, it should be apparent that a variety of suitable materials would be suitable for use in the composition or method of making the golf balls according to the Detailed Description of the Invention. Accordingly, all expedient modifications readily attainable by one of ordinary skill in the art from the disclosure set forth herein are deemed to be within the spirit and scope of the present claims.

What is claimed is:

1. A golf ball comprising:

a core comprising a material formed from a controlled-isomer polybutadiene polymer, a crosslinking agent, and a free-radical initiator, or a reaction product thereof;

and a cover having a plurality of dimples disposed about the core, wherein the controlled-isomer polybutadiene includes at least about 10 percent to 60 percent trans-isomer and less than about 9 percent vinyl-isomer.

2. The golf ball of claim 1, wherein the cover has at least one of a dimple coverage of greater than about 60 percent, a hardness from about 35 to 80 Shore D, or a flexural modulus of greater than about 500 psi, and wherein the golf ball has at least one of a compression from about 50 to 120 or a coefficient of restitution of greater than about 0.7.

3. The golf ball of claim 1, wherein the core has an effective modulus of no greater than about 10,000 psi.

4. The golf ball of claim 1, wherein the core has an effective modulus of no greater than about 8,000 psi.

5. The golf ball of claim 1, wherein the material has less than about 5 percent vinyl-isomer.

6. The golf ball of claim 1, wherein the controlled-isomer polybutadiene has an absolute molecular weight average of at least about 210,000.

7. The golf ball of claim 5, wherein the controlled-isomer polybutadiene has an absolute molecular weight average of at least about 350,000.

8. The golf ball of claim 6, wherein the controlled-isomer polybutadiene has an absolute molecular weight average of at least about 350,000.

9. The golf ball of claim 1, wherein the controlled-isomer polybutadiene has a polydispersity of no greater than about 2.5.

10. The golf ball of claim 1, wherein the controlled-isomer polybutadiene has a polydispersity of no greater than about 2.

11. The golf ball of claim 1, wherein the controlled-isomer polybutadiene has both an absolute molecular weight of at least about 210,000 and a polydispersity of no more than about 3 prior to crosslinking.

12. The golf ball of claim 1, wherein the controlled isomer polybutadiene includes from about 20 percent to 60 percent trans-isomer.

13. The golf ball of claim 1, wherein the controlled isomer polybutadiene includes from about 15 percent to 60 percent trans-isomer.

14. The golf ball of claim 1, wherein the core comprises a center and at least one intermediate layer.

15. The golf ball of claim 14, wherein the center comprises the material.

16. The golf ball of claim 14, wherein the center comprises a fluid.

17. The golf ball of claim 14, wherein at least one of the intermediate layers comprises a tensioned elastomeric thread wound about the center.

18. The golf ball of claim 17, wherein the tensioned elastomeric thread comprises the material.

19. The golf ball of claim 17, wherein the isomers of the controlled-isomer polybutadiene have random, pseudo-random, or block distribution along a single backbone.

20. The golf ball of claim 1, wherein the controlled-isomer polybutadiene is provided in the form of regrind having a particle size of about 0.1 micrometers to 1000 micrometers.

21. The golf ball of claim 1, wherein the controlled-isomer polybutadiene has a substantially uniform amount of trans-isomer after polymerization.

22. A method of preparing a golf ball, which comprises:

combining a crosslinking agent, a free-radical initiator, and an uncrosslinked controlled-isomer polybutadiene having an absolute molecular weight of at least about 210,000 and a polydispersity of no more than about 3 to form a core mixture;

forming a golf ball core having a material comprising the core mixture, or a product thereof; and providing a cover having a plurality of dimples about the core, wherein the controlled-isomer polybutadiene includes at least about 10 percent to 60 percent trans-isomer and no more than about 9 percent vinyl-isomer.

23. The method of claim 22, wherein the forming step comprises:

forming a center, and providing at least one intermediate layer about the center.

24. The method of claim 23, wherein the center comprises the controlled-isomer polybutadiene.

25. The method of claim 23, wherein the at least one intermediate layer comprises the controlled-isomer polybutadiene and the center comprises a fluid.

26. The golf ball of claim 1, wherein the free radical initiator comprises a peroxide.

27. A golf ball comprising:

a core formed from a composition comprising:

a polybutadiene polymer component comprising about 10 percent to 60 percent trans-isomer and less than about 9 percent vinyl-isomer;

a crosslinking agent; and a free radical initiator present in an amount of about 2 parts per hundred or less of the polymer component; and a cover having a plurality of dimples disposed about the core.

28. The golf ball of claim 27, wherein the composition further comprises a cis-to-trans catalyst.

29. The golf ball of claim 27, wherein the free radical initiator comprises a peroxide.

30. The golf ball of claim 27, wherein the crosslinking agent is present in an amount of about 10 to 25 parts per hundred of the polymer component.

* * * * *